US005291092A

United States Patent [19]

Coushaine

[11] Patent Number: 5,291,092

[45] Date of Patent: Mar. 1, 1994

[54] HID VEHICLE HEADLAMP CAPSULE ASSEMBLY

[75] Inventor: Charles M. Coushaine, Rindge, N.H.

[73] Assignee: GTE Products Corporation, Danvers, Mass.

[21] Appl. No.: 874,284

[22] Filed: Apr. 24, 1992

[51] Int. Cl.[5] ..... H01J 5/58

[52] U.S. Cl. ..... 313/318; 313/113; 362/226

[58] Field of Search ..... 313/318, 113; 362/257, 362/255, 217, 263, 285, 225, 226; 403/371, 367, 365, 368; 174/152 R, 154, 163 R

[56] References Cited

U.S. PATENT DOCUMENTS

| | | | |
|---|---|---|---|
| 4,201,438 | 5/1980 | Shea | 313/318 |
| 4,642,739 | 2/1987 | Daumuller et al. | 313/318 |
| 4,868,456 | 9/1989 | Sanders et al. | 313/318 |
| 5,032,758 | 7/1991 | Davenport et al. | 313/318 |
| 5,039,904 | 8/1991 | Kosmatka et al. | 313/318 |
| 5,130,911 | 7/1992 | Eisner, Sr. | 313/318 |
| 5,154,558 | 10/1992 | McCallion | 403/371 |

*Primary Examiner*—Donald J. Yusko
*Assistant Examiner*—Vip Patel
*Attorney, Agent, or Firm*—William E. Meyer

[57] ABSTRACT

An arc discharge headlamp capsule having arc tube, wedge, retainer, forward connector rod, insulating sleeve, RF ring, and base is disclosed. The wedge is formed to mate with an end of the arc tube, and be compressed along its exterior by the retainer. The wedge and retainer are sonically welded. The compressed wedge then gently, but firmly holds the arc tube. The thermal conduction from the arc tube is additionally consistent from lamp to lamp. The arc discharge headlamp capsule held by the wedge and retainer structure yields a lamp tube securely, and precisely held with even pressure.

13 Claims, 3 Drawing Sheets

HID VEHICLE HEADLAMP CAPSULE ASSEMBLY

1. TECHNICAL FIELD

The invention relates to electric lamps and particularly to small volume arc discharge lamps. More particularly the invention is concerned with a support structure for a small volume arc discharge automobile lamp.

2. BACKGROUND ART

Small volume arc discharge lamps are now being developed for use as vehicle headlamps. These lamps offer long service lives, with high electrical efficiency. Moreover, these lamps have small optical sources, and can therefore provide overall improved headlamp optics. The enclosed volume of these lamps is roughly that of a pea, so the whole lamp may be conveniently formed initially from a small diameter quartz tube. Since the light source is small, the reflector optics may be made correspondingly small. The difficulty is then that the arc must be precisely located in the reflector. The lamp, when ignited, becomes quite hot, and therefore needs support by materials that can withstand the high operation temperature. Metals and ceramics have been used to support the arc tube, since these materials can easily withstand the high temperatures. Unfortunately, these materials are hard, and precise coupling of the arc tube with the metal or ceramic support structure can result in strain between the arc tube and the support. Since the practical manufacture of arc tubes, and metal or ceramic support structures normally results in some dimensional variation of the parts, some manufactured lamp tubes will have high contact, and stress, while others will have low contact and stress. The coupling stress is made worse by the thermal expansion and contraction of the components as the lamp is turned on and off. Arc tube fracture is then the final result in a portion of arc tubes pinched in metal support structures. There is then a need for an arc discharge headlamp capsule that can withstand the temperatures of operation, and still precisely locate the arc tube without excessive stress the arc tube.

A related problem concerns the energy management of the arc tube. The physics of the arc process is carefully designed for a particular operation temperature. Where thermal conduction from the arc tube differs, for example where the support structure has a low or high amount of contact with the arc tube, heat builds up, or is lost too quickly from the arc tube. The physics of the arc changes, thereby affecting the lamp optics, life and color. There is then a need for a support structure that from one arc tube to the next forms a consistent thermal contact.

Related prior patents include the following:

U.S. Pat. No. 4,734,612 issued to Hiroki Sasaki et al on Mar. 29, 1988 for a High Pressure Metal Vapor Discharge Lamp shows a double ended lamp capsule with leads welded to support wires. One support wire extends through a insulating sleeve and then, in parallel with the second wire, extend through a seal area of an enclosing capsule. Sasaki is generally concerned with an insulated preheater.

U.S. Pat. No. 4,754,373 issued to Lee W. Otto et al on Jun. 28, 1988 for a Automotive Headlamp shows a double ended filamented lamp capsule positioned in an automobile headlamp reflector. Otto shows generally how a double ended lamp capsule may be weleded and aligned axially as part of a headlamp.

U.S. Pat. No. 5,032,758 issued to John M. Davenport et al on Jul. 16, 1991 for a Precision Tubulation for Self Mounting Lamp shows an arc discharge axially aligned on a headlamp capsule.

U.S. Pat. No. 5,036,439 issued to Friedich Hoffmann et al on Jul. 30, 1991 for a Car Headlight Lamp and Method of Manufacturing Same shows a double ended arc discharge lamp capsule held in a metal reflector or shield. The reflector includes spring tabs that press against the lamp tube to properly position the shield.

U.S. Pat. No. 5,039,904 issued to Walter J. Kosmatka on Aug. 13, 1991 for a Mount for Miniature Arc Lamp shows a double ended arc discharge tube, axially mounted in a headlamp. One end of the tube is captured in a threaded structure including O-rings. The forward lead is ducted away from the capsule base to pass through the reflector body for exterior electrical connection.

U.S. Pat. No. 5,051,658 issued to Dirk Van Pijkeren on Sep. 24, 1991 for a an Electric High-Pressure Discharge Lamp for Use as a Motor Vehicle Headlamp shows a double ended arc discharge tube. The length of one end is pinched between two metal arms. The arms are supported on a bush that is in turn connected to a tube and holder body.

U.S Pat. No. 5,059,855 issued to Shinichi Irisawa et al on Oct. 22, 1991 for a Discharge Lamp Base Construction shows a double ended arc discharge tube welded by its leads at each end. The forward lead extends back through an insulating sleeve to a base. The leads are otherwise ducted through the body of the base.

DISCLOSURE OF THE INVENTION

An arc discharge headlamp capsule that provides a low stress, adaptable coupling for the arc discharge capsule may be formed from an arc discharge tube having a forward end with a forward lead, and a rear end with a rear lead; a wedge having an axis, an interior wall formed to be conformal with the rear end of the arc tube, and a sloped exterior wall, positioned around the rear end of the arc discharge tube, with the exterior wall sloped away from the forward end of the arc tube; a retainer, having an axis, a sloped interior wall defining a central passage and an interior cavity substantially conformal with the exterior wall of the wedge, positioned around and mated to the wedge to substantially butt the exterior wall of the wedge to the interior wall of the retainer; a base supporting the retainer; means for electrically connecting the forward lead; and means for electrically connecting the rear lead.

BEST MODE FOR CARRYING OUT THE INVENTION

Figure 1:
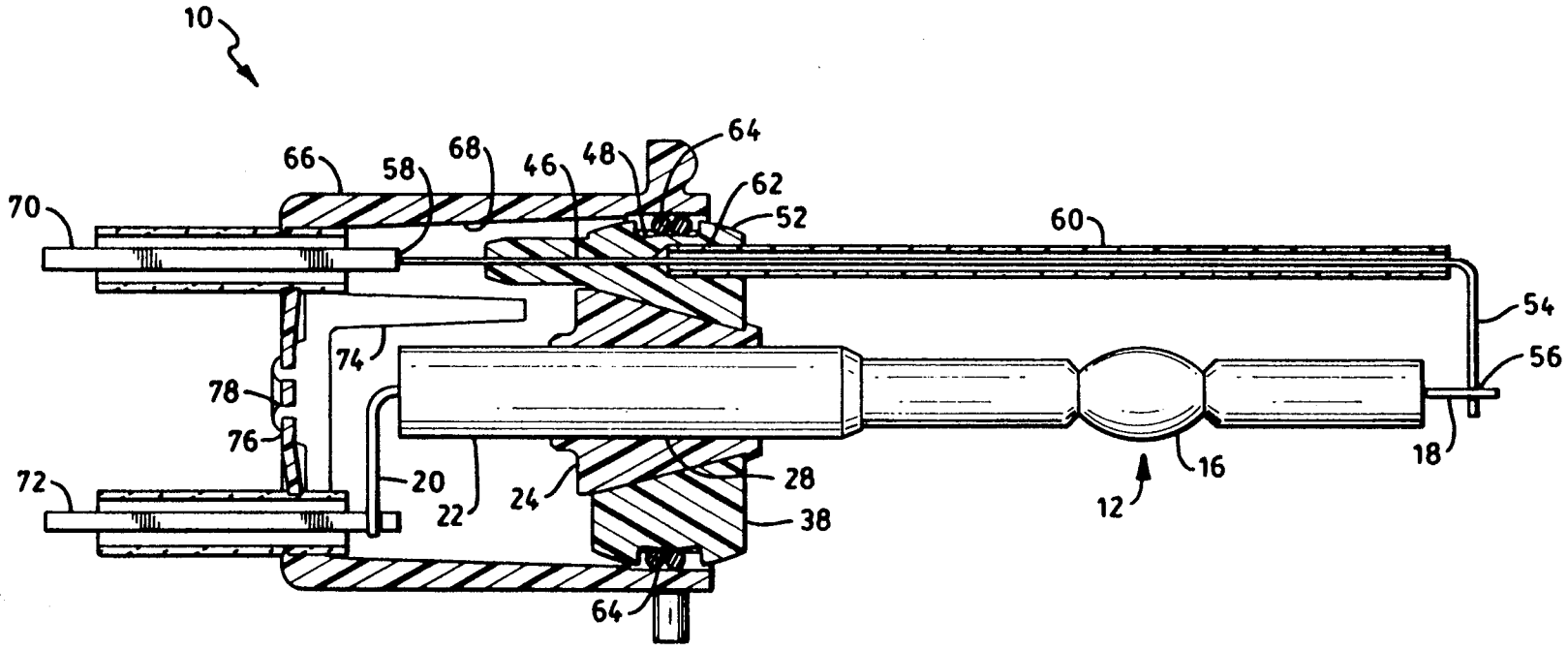
FIG. 1 shows a cross sectional view of a preferred embodiment of an arc discharge headlamp capsule.

FIG. 1 shows a preferred embodiment of an arc discharge headlamp capsule 10. The arc discharge headlamp capsule may be assembled from a doubled ended arc tube 12, wedge 24, retainer 38, forward connector rod 54, insulating sleeve 60, RF ring 64, base 66, first connector 70, second connector 72, and strain relief 76.

The doubled ended arc tube 12 may be formed from a quartz tube to include an arc discharge envelope 16 electrically supplied at a forward end through a forward lead 18, and a rear lead 20, at a rear end 22. The preferred arc tube 12 is a cylindrical quartz tube, with a closed arc discharge envelope 16 formed along a middle region of the tube. The arc discharge envelope 16 may vary in size and shape, but examples are known to include an enclosed volume of about 0.20 to 0.50 milliliter. Extending forward along the axis of the arc tube 12 is a forward lead 18 that is typically press or vacuum sealed to the quartz tubing. Extending rearward along the axis of the arc tube 12 is a similar sealed rear lead 20. By way of example arc tube 12 is shown as a cylindrical, double ended, press sealed arc tube with an approximately elliptical arc discharge envelope. Most other double ended configurations may be used.

Figure 2:
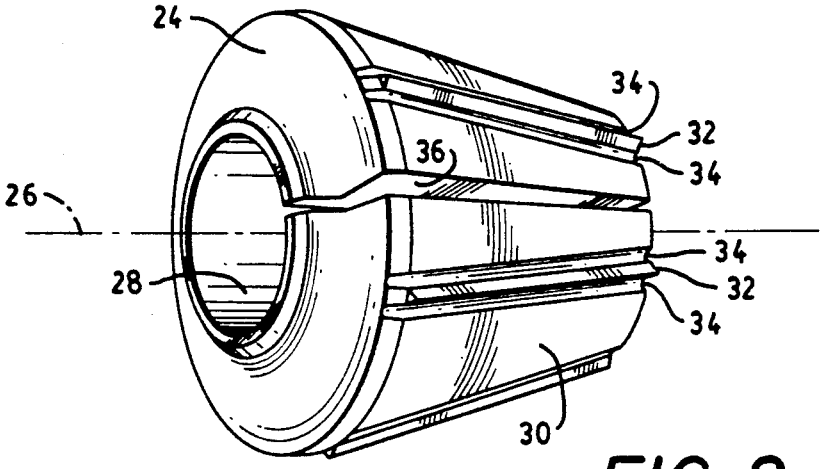
FIG. 2 shows a side to rear perspective view of a wedge.
Figure 3:
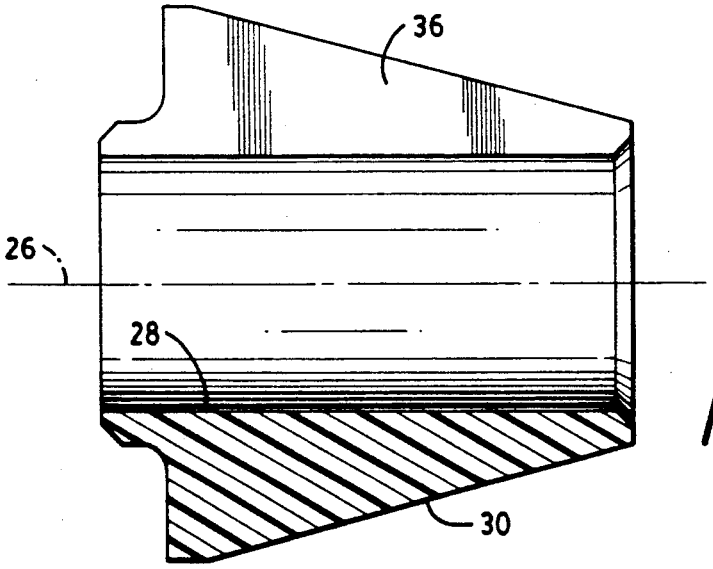
FIG. 3 shows an axial cross sectional view of a wedge.
Figure 4:
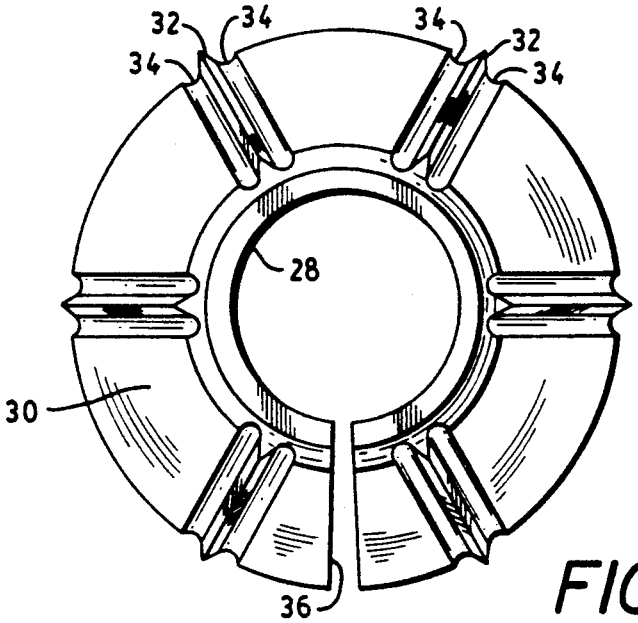
FIG. 4 shows a forward end view of a wedge.

FIG. 2 shows a side to rear perspective view of a wedge. FIG. 3 shows an axial cross sectional view of a wedge. FIG. 4 shows a forward end view of a wedge. The rear end 22 of the arc tube 12 slips axially into the wedge 24. The wedge 24 is formed from a slightly flexible, high temperature resistant material, such as a glass filled polyamide-nylon plastic. The wedge 24 has a wedge axis 26, an interior cylindrical wall 28, and a conical exterior wall 30. Formed in the wedge 24 is an interior wall designed to be conformal with the surface of the rear end 22 of the arc tube 12. Since the preferred arc tube 12 is cylindrical, the preferred wedge 24 interior wall is cylindrical. The preferred wedge 24 is also axially split on one side by an axial split wall 36 to form a narrow gap. The preferred axial split wall 36 joins the interior cylindrical wall 28 to the conical exterior wall 30 thereby forming an expansion gap allowing expansion and contraction of the interior passage. Since the wedge 24 is slightly flexible, the axial gap allows the diameter of the interior cylindrical wall 28 to be slightly expanded or contracted. The expansion and contraction allows the wedge 24 to be accurately fitted to the arc tube 12.

The exterior wedge surface is sloped, and the preferred embodiment has a generally conical form, coaxially aligned with the wedge axis 26. In the preferred embodiment, the conical exterior wall 30 also includes coaxial ribs 32 and on each side of each rib 32 are adjacent troughs 34. The preferred axial ribs 32 extend above the surrounding surface of the conical exterior wall 30 and thereby act as the first contact points when the wedge 24 is positioned in and against a similarly shaped conical cavity. The troughs 34 are indentations in the conical surface, extending adjacent each rib 32, and having a combined cavity volume approximately equal to the volume of the respectively adjacent extended rib 32. When the ribs 32 are melt fused, the troughs 34 act as reservoirs to receive and retain the melting wedge material. By way of example ribs 32 are shown as having blade shapes, while the troughs 34 are shown as having semicircular cross sections. Other cross sectional configurations where volume of the ribs 32 approximates the volume of the troughs 34 are thought to be acceptable. The troughs 34 may be eliminated from the design, but sealing alignment between the wedge 24 and the retainer 38 is thought to then be less accurately controlled. The ribs 32 also act as energy focusers that determine the first melting points during sonic welding.

Figure 5:
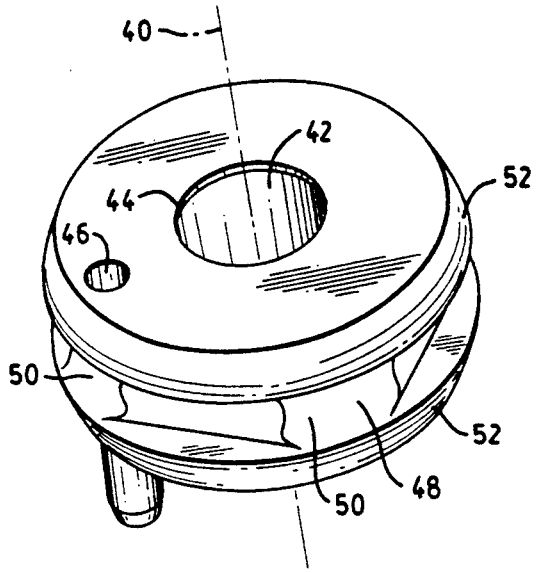
FIG. 5 shows a perspective view of a retainer.
Figure 6:
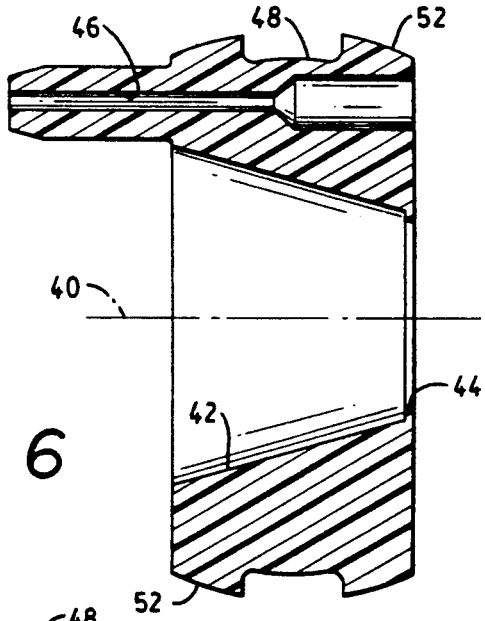
FIG. 6 shows an axial cross sectional view of a retainer.
Figure 7:
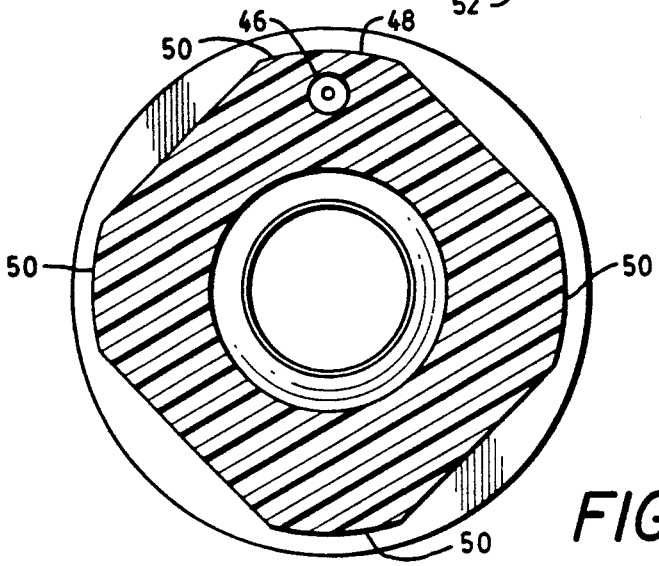
FIG. 7 shows a transaxial cross sectional view of a retainer.

FIG. 5 shows a perspective view of a retainer 38. FIG. 6 shows an axial cross sectional view of a retainer 38. FIG. 7 shows a transaxial cross sectional view of a retainer 38. The wedge 24 is designed to fit axially and conformally into the retainer 38. The retainer 38 has a retainer axis 40, a conical interior wall 42 defining a conical cavity, and a forward lead passage 46. The cavity defined by the interior wall 42 is intended to substantially mate with the exterior wall of the wedge 24. The two surfaces should then be similarly sloped. In the preferred embodiment, the two surfaces are generally conical, with similar slopes. The preferred conical interior wall 42 is coaxial with the retainer axis 40, and is similar to the conical exterior wall 30 of the wedge 24. In the preferred embodiment, a retainer lip 44 is formed at the forward end of the conical interior wall 42. The retainer lip 44 extends slightly into the conical cavity, and extends slightly along the retainer axis 40. The retainer lip 44 should be relatively small in height, perhaps less than or equal to the height of the axial rib 32 formed on the wedge 24, or less than or equal to one percent of the diameter of the conical cavity where the retainer lip 44 is located. The wedge 24 may then be snuggly fitted to the retainer 38 with ribs 32 butted against the conical interior wall 42. The ribs 32 also contact the retainer lip 44, but the retainer lip 44 is not so large as to prevent rib 22 to interior wall 42 contact. The retainer 38 also includes a forward lead passage 46 that extends from a forward side, through to a rear side of the retainer 38. The forward lead passage 46 may be positioned to be offset from the conical interior wall 42. The exterior surface of the retainer 38 is formed to include an exterior RF ring channel 48. The exterior RF ring channel 48 encircles the retainer 38 in a plane perpendicular to the retainer axis 40, and is located adjacent where the retainer 40 couples to the base 66. The preferred RF ring channel 48 additionally includes four spreaders 50 positioned at approximately equal angles around the retainer axis 40. The exterior limits of the spreaders 50 have greater radial distance from the retainer axis 40 than do the intermediate RF ring channel 48 portions, thereby forming hills and valleys along the RF ring channel 48.

The forward connector rod 54 may be any sufficiently stiff and conductive rod for electrically connecting the forward end of the lamp capsule. The retainer 38, along the forward lead passage 46, fits axially and conformally over the forward connector rod 54. The forward lead 18 is welded to the forward connector rod 54 at a forward weld 56. The forward connector rod 54 is similarly welded at a rear weld 58 to a first connector 70. A crimp connector may also be used.

The forward connector rod 54 passes through an insulating sleeve 60. The insulating sleeve 60 may be made of an insulating ceramic in the form of long tube. The retainer 38 may support the insulating sleeve 60 along the rear end 62 portion. In the preferred embodiment, a rear portion of the insulating sleeve 60 is inserted in the forward lead passage 46 of the retainer 38. In the preferred embodiment, the ceramic insulating sleeve 60 has a loose fitting clearance fit to retainer 38.

The loose fit prevents the sleeve from being stressed and fractured if bumped. The retainer 38 clasps the insulating sleeve 60 at a rear end 62, while the forward connector rod 54 is substantially enclosed in the insulating sleeve 60. By way of example, insulating sleeve 60 is shown as a long cylindrical tube made of steatite ceramic.

The retainer 38 is encircled in the exterior groove by an RF ring 64. The RF ring 64 is formed from a metal, and therefore subject to radio frequency (RF) radiation heating. When positioned to contact the retainer 38 in the exterior RF ring channel 48, the RF ring 64 can be fused to a plastic that melts when in contact with a heated metal. The preferred RF ring 64 is a coil of springy metal wire. A coil of two or three turns has been found to be sufficient. By way of example, RF ring 64 is shown as a two turn coil of stainless steel. Other suitable ring configurations are thought to be applicable also.

The retainer 38 is held in the base 66. The base 66 is formed with a cylindrical interior wall 68 having nearly the same diameter as the exterior spherical section wall 48 of the retainer 38. The rear portion of the interior cavity is divided by an interior wall 74. Welded to the rear end of the forward connector rod 54 is a first connector 70. The first connector 70 is positioned to extend from the interior of the base 66 to the rear exterior of the base 66. The preferred first connector 70 is a metal wire enclosed in an insulating sleeve. Welded to the rear lead 20, and again extending from the interior of the base 66 to the rear exterior of the base 66 is a second connector 72. The preferred second connector 72 is also a metal wire enclosed in an insulating sleeve. Positioned along base 66 between the first connector 70 and the second connector 72 is an interior dividing wall 74. The interior dividing wall 74 enhances the electrical insulation between rear lead 20 and the forward connector rod 54 connections. Arc lamps are started with high voltage spikes that can short circuit between the inputs leads if not adequately guarded against. The preferred interior dividing wall 74 is a molded section of the base 66.

Positioned along base 66 between the first connector 70 and the second connector 72 is a strain relief 76. Strain relief 76 helps keep the first connector 70 and second connector 72 from twisting in the base. The preferred strain relief 76 is a plastic spring with ends formed to conformally press against the exterior portions of the first connector 70 and the second connector 72. In the middle region of the strain relief 76 a hole is formed to fit over a protuberance 78 of the plastic base 66. The preferred protuberance 78 has a cylindrical base with a conical cap. The protuberance 78, and in particular, the conically capped protuberance 78, may be sonically melted to lock the strain relief 76 in place. The preferred base 66 is additionally formed with exterior surface features for aligning, sealing, and locking the lamp capsule in place in a lamp receptacle. Such surface features (bayonet mount ring, O-ring seal, lock ring and so forth) are felt to be features of common skill subject to a particular designer's preference.

An arc discharge lamp capsule may be assembled by first forming a double ended arc discharge tube with a forward lead 18 extending from one end, and a rear lead 20 protruding from an opposite second end. A retainer 38 is positioned around the rear end 22 of the tube. The rear end 22 of the capsule is threaded through a wedge 24. Since the wedge 24 is slightly flexible, the wedge 24 may be opened by expanding the gap adjacent the split wall 36. The diameter of the interior cylindrical passage may then be expanded slightly, if needed. Similarly, the split gap may be closed slightly, and the interior cylindrical passage may be narrowed. The arc tube 12, and wedge 24 fit may then be adjusted to accommodate any manufacturing variances. The wedge 24 is advanced along the tube until the wedge 24 exterior ribs 32 butt against the conical interior wall 42 and retainer lip 44. An insulating sleeve 60 is inserted into the retainer 38's forward lead passage 46, and a forward connector rod 54 is slipped through the insulating sleeve 60 to leave a forward end adjacent the forward lead 18, while a rear end 62 of the connector rod 54 extends out the rear side of the retainer 38. The forward lead 18 and forward connector rod 54 are then welded together to mechanically hold the forward end of the arc discharge tube, and electrically connect the forward lead 18. The arc tube 12, and wedge 24 coupling is adjusted as the wedge 24 mates with the retainer 38. The wedge 24 then places a small, and broadly distributed clamping stress on the arc tube 12. The mechanical stress on the arc tube 12 is then small, and unlikely to cause fracture of the arc tube 12. Additionally, the thermal contact between the arc tube 12, and wedge 24 is similar, if not effectively equal, from one lamp assemble to the next. The wedge 24 and retainer 38 are then sonically welded together to hold the accuracy of the fitted clamping permanently. The energy directing ribs 32 melt, and fuse with the adjacent conical interior wall 42, and retainer lip 44. Excess material from the melting ribs 32 runs off into the adjacent troughs 34 allowing the conical exterior wall 30 to fit precisely against the conical interior wall 42. The wedge 24 and retainer 38 are then firmly, and precisely fixed to each other. The RF ring 64 is then mounted in the exterior RF ring channel 48. The rear end extension of the forward connector rod 54 is butt welded to the first connector 70. The rear lead 20 is welded to the second connector 72. The assembly of the arc tube 12, wedge 24, retainer 38, forward connector rod 54, insulating sleeve 60, RF ring 64, first connector 70 and second connector 72 is then inserted in the tubular end of the base 66. The first connector 70 is threaded through a first hole in the base 66, while the second connector 72 is threaded through a second hole in the base 66. The strain relief 76 is then positioned between the exterior portions of the first connector 70 and second connector 72 with the center hole of the strain relief 76 positioned around the protuberance 78. The exposed part of the protuberance is then sonically melted to trap the strain relief 76 in place. The first connector 70 and second connector 72 are then electrically coupled to a starter and ballast. The lamp is then lit. The arc tube 12 is then positioned in a preferred location by rotating and pivoting the retainer 38 along the spherical section exterior surface 52 with respect to the cylindrical interior wall 68. The rotation and pivoting motions have relatively small dimensions, perhaps a millimeter at most. With the arc of the arc tube 12 in the preferred position, the RF ring 64 may be heated by a radio frequency power source to fuse the retainer 38 along the spreaders 50 with the heated RF ring 64, and the heated RF ring 64 similarly fuses to the base 66 along the cylindrical interior wall 68. The arc tube 12 is then fixed properly, and permanently in place.

Equivalent results may be obtained by positioning the ribs and troughs of the cylindrical interior wall, or positioning ribs and troughs on both the wedge and retainer.

The wedge, and retainer need not have conical wall sections, but need only to have mutually conformal wall sections that can be axially butted together. The wedge and retainer pieces may be butt one to the other for precise joining of the two. Sonic welding of the wedge to the retainer is preferred, but gluing or other couplings may be used also.

In a working example some of the dimensions were approximately as follows: The arc tube was made of quartz and had a length of about 6.2 centimeters, and a diameter of 6.0 millimeters. The conical wedge was made of a glass filled polyamide-nylon (Amodel A-1133), and had an interior cylindrical wall diameter of 6.0 millimeters. The exterior diameter was 13.08 millimeters, and the overall height was 12.07 millimeters. The wedge had a conical exterior wall with a slope of 15 degrees, and six axial ribs with heights of 0.38 millimeters and 60 degree blade like edges. Adjacent on each side of each rib was a trough (six ribs, twelve troughs) with a semicircular cross section. A six degree gap was formed in the wedge forming an axial split. The retainer was made of a glass filled polyamide-nylon (Amodel A-1133), and had a conical interior wall with a fifteen degree slope, and a 9.52 millimeter depth. A retainer lip was formed at the forward end of the conical interior wall that extended into the conical interior 0.00254 millimeters (0.0001 inch), and along the axis 0.000254 millimeters (0.00001 inch). The retainer also had a forward lead passage, an exterior RF ring channel, four spreaders positioned equally around the retainer axis. The exterior surface of the retainer had a portion in the form of a spherical section having a diameter of 22.22 millimeters. The forward connector rod was made of nickel plated steel, and had a forward weld to the forward lead, a rear weld to the first connector. The insulating sleeve was made of a ceramic (steatite), and was about 4.8 centimeters long, and had about a 2.0 millimeter outer diameter, and a 1.0 millimeter inside diameter. The RF ring was made of 1.27 millimeter (0.05 inch) stainless steel wire formed in a 19.43 millimeter (0.765 inch) diameter coil of two and a quarter turns. The base was made of a glass filled polysulfone (Mindel) plastic and was roughly in the form of a molded cup. The maximum diameter of the base, around an exterior positioning and mounting ring, was 32.00 millimeters, and the height was 26.47 millimeters. The inner diameter of the cup was 22.34 millimeters. The inner base of the cup was divided by an internal wall about 12.0 millimeters high. On each side of the internal wall, a 3.99 millimeters diameter hole was formed in the bottom of the base (cup). A positioning and mounting ring was formed on the exterior of the base near the top of the tubular exterior wall (lip of the cup). A 3.18 millimeter diameter protrusion with a conical cap was centrally formed on the rear exterior of the base (bottom of the cup) to be located in a hole formed in the strain relief. The strain relief was formed from a flat, rectangular spring of a polysulfone plastic (Ultem) with two semicircular indentations at opposite ends. Each end was bent up at 6 degrees to form a compressible spring clip. A circular hole of 3.3 millimeters was formed in the middle. The disclosed dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims. The wedge and retainer may have sloped faces that are mateable, but not conical. The wedge and retainer may be reoriented so the wedge inserts into the front of the retainer. Other means for coupling the retainer to the base may be positioned in the ring channel, including epoxy, and spring clips.

What is claimed is:

1. An arc discharge headlamp capsule comprising:

a) an arc discharge tube having a forward end with a forward lead, and a rear end with a rear lead, b) a wedge having an axis, an interior wall defining an interior passage formed to be conformal with the rear end of the arc tube, and a sloped exterior wall, positioned around the rear end of the arc discharge tube, c) a retainer, having an axis, a sloped interior wall defining a central passage and an interior cavity substantially conformal with the exterior wall of the wedge, positioned around and mated to the wedge to substantially butt the exterior wall of the wedge to the interior wall of the retainer, d) a base supporting the retainer, e) a first electrical connection electrically connecting the forward lead, and f) a second electrical connection electrically connecting the rear lead.

2. The apparatus in claim 1, wherein the exterior wall of the wedge has a generally conical form.

3. The apparatus in claim 1, wherein the wedge includes an axial split wall joining the interior wall to the exterior wall thereby forming a expansion gap allowing expansion and contraction of the interior passage.

4. The apparatus in claim 1, wherein the wedge is bonded to the retainer.

5. An arc discharge headlamp capsule comprising:

a) an arc discharge tube having a forward end with a forward lead, and a rear end with a rear lead, b) a wedge having an axis, an interior wall defining an interior passage formed to be conformal with the rear end of the arc tube, and a sloped exterior wall including at least one axial rib formed on the exterior wall, the wedge being positioned around the rear end of the arc discharge tube, c) a retainer, having an axis, a sloped interior wall defining a central passage and an interior cavity substantially conformal with the exterior wall of the wedge, positioned around and mated to the wedge to substantially butt the exterior wall of the wedge to the interior wall of the retainer, d) a base supporting the retainer, e) a first electrical connection electrically connecting the forward lead, and f) a second electrical connection electrically connecting the rear lead.

6. The apparatus in claim 5, wherein adjacent the axial rib of the wedge is a trough.

7. The apparatus in claim 5, wherein the axial rib has a blade like edge.

8. An arc discharge headlamp capsule comprising:

a) an arc discharge tube having a forward end with a forward lead, and a rear end with a rear lead, b) a wedge having an axis, an interior wall defining an interior passage formed to be conformal with the rear end of the arc tube, and a sloped exterior wall including a plurality of axial ribs formed on the exterior wall, the wedge being positioned around the rear end of the arc discharge tube, c) a retainer, having an axis, a sloped interior wall defining a central passage and an interior cavity substantially conformal with the exterior wall of the wedge, positioned around and mated to the wedge to substantially but the exterior wall of the wedge to the interior wall of the retainer, d) a base supporting the retainer, e) a first electrical connection electrically connecting the forward lead, and f) a second electrical connection electrically connecting the rear lead.

9. The apparatus in claim 8, wherein adjacent each of the axial ribs is a trough.

10. An arc discharge headlamp capsule comprising:

a) an arc discharge tube having a forward end with a forward lead, and a rear end with a rear lead, b) a wedge having an axis, an interior wall defining an interior passage formed to be conformal with the rear end of the arc tube, and a sloped exterior wall, positioned around the rear end of the arc discharge tube, c) a retainer, having an axis, a sloped interior wall defining a central passage and an interior cavity substantially conformal with the exterior wall of the wedge, positioned around and mated to the wedge to substantially butt the exterior wall of the wedge to the interior wall of the retainer, wherein a portion of the exterior surface of the retainer adjacent the base has the form of a section of sphere, and adjacent the spherical surface portion, the exterior surface of the retainer is also formed to define a ring channel extending around the retainer axis, formed to include at least one spreader comprising a region of a relatively greater diameter, adjacent regions of relatively less diameter and a metal ring positioned in the ring channel, and fused in at least one first place to the retainer, and fused in at least one second place to the base for coupling the retainer to the base, d) a base supporting the retainer, e) a first electrical connection electrically connecting the forward lead, and f) a second electrical connection electrically connecting the rear lead.

11. An arc discharge headlamp capsule comprising:

a) an arc discharge tube having a forward end with a forward lead, and a rear end with a rear lead;

b) a wedge having an axis, an interior wall defining an interior passage formed to be conformal with the rear end of the arc tube, and a sloped exterior wall, positioned around the rear end of the arc discharge tube, the exterior wall including a lip edge formed transaxially around the exterior wall having a height less than or equal to one percent of the diameter of the exterior where the lip edge is positioned;

c) a retainer, having an axis, a sloped interior wall defining a central passage and an interior cavity substantially conformal with the exterior wall of the wedge, positioned around and mated to the wedge to substantially butt the exterior wall of the wedge to the interior wall of the retainer;

d) a base supporting the retainer;

e) a first electrical connection electrically connecting the forward lead, and f) a second electrical connection, electrically connecting the rear lead.

12. An arc discharge headlamp capsule comprising:

a) an arc discharge tube having a forward end with a forward lead, and a rear end with a rear lead;

b) a wedge having an axis, an interior wall defining an interior passage formed to be conformal with the rear end of the arc tube, and a sloped exterior wall, positioned around the rear end of the arc discharge tube, the exterior wall sloped away from the forward end of the arc tube, having a plurality of axial ribs formed on the exterior wall, and adjacent each of the axial ribs is a tough, an axial split wall joining the interior wall to the exterior wall thereby forming a expansion gap allowing expansion and contraction of the interior passage c) a retainer, having an axis, a sloped interior wall defining a central passage and an interior cavity substantially conformal with the exterior wall of the wedge, positioned around and mated to the wedge to substantially butt the exterior wall of the wedge to the interior wall of the retainer, a portion of the exterior surface of the retainer adjacent the base has the form of a section of a sphere, and adjacent the spherical surface portion, the exterior surface of the retainer is also form to a define a ring channel extending around the retainer axis, d) a metal ring positioned in the ring channel of the retainer, fused in at least one first place to the retainer, and fused in at least one second place to a base, e) a base supporting the retainer, f) means for electrically connecting the forward lead, and g) means for electrically connecting the rear lead.

13. The apparatus in claim 12, wherein the ribs are melted to bond the wedge to the retainer.

* * * * *